US007331125B2

(12) United States Patent
Bray, Jr. et al.

(10) Patent No.: US 7,331,125 B2
(45) **Date of Patent: *Feb. 19, 2008**

(54) SLIPPER INSOLE, SLIPPER, AND METHOD FOR MANUFACTURING A SLIPPER

(75) Inventors: Walter Thomas Bray, Jr., Reynoldsburg, OH (US); Theresa Stewart, Columbus, OH (US)

(73) Assignee: R.G. Barry Corporation, Pickerington, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/317,373

(22) Filed: Dec. 22, 2005

(65) Prior Publication Data

US 2006/0130366 A1 Jun. 22, 2006

Related U.S. Application Data

(63) Continuation of application No. 10/213,276, filed on Aug. 5, 2002, now Pat. No. 6,990,754.

(51) Int. Cl.
*A43B 13/38* (2006.01)

(52) U.S. Cl. ..... 36/44; 36/141; 36/3 B; 36/17 A; 36/11; 36/28

(58) Field of Classification Search ..... 36/43, 36/44, 71, 9 R, 15, 18, 26, 25 R, 16, 17 A; 12/142 T, 142 G See application file for complete search history.

(56) References Cited

U.S. PATENT DOCUMENTS

| | | | |
|---|---|---|---|
| D62,799 | S | 7/1923 | Hirshfield |
| D64,599 | S | 5/1924 | Muntener |
| RE18,237 | E | 10/1931 | Messler |

(Continued)

FOREIGN PATENT DOCUMENTS

| | | |
|---|---|---|
| EP | 0 384 008 | 8/1990 |

(Continued)

OTHER PUBLICATIONS

Communication from European Patent Office regarding European Patent Application Serial No. 03 767 179.9, dated Feb. 3, 2006 (4 pages).

(Continued)

*Primary Examiner*—Jila M Mohandesi
(74) *Attorney, Agent, or Firm*—Merchant & Gould P.C.

(57) ABSTRACT

An insole is described that can be placed with an insole receiving area of a slipper. The insole can be prepared by compression molding a structure comprising a foam layer having a first foam side and a second foam side. The insole includes a heel region, an arch region, and a toe region. The heel region includes a heel cushioning portion and a heel perimeter portion. The heel perimeter portion includes a retaining wall that extends above the top surface of the heel cushioning portion. The arch region includes an arch cushioning portion and an arch perimeter portion. The arch perimeter portion includes an arch support that extends above the top surface of the arch cushioning portion. The toe region includes a toe cushioning portion and a toe perimeter portion. A slipper and a method for manufacturing a slipper are described.

29 Claims, 5 Drawing Sheets

U.S. PATENT DOCUMENTS

| | | | | |
|---|---|---|---|---|
| D119,742 | S | | 4/1940 | Debusschere |
| D120,316 | S | | 4/1940 | Reeves |
| D135,347 | S | | 3/1943 | Pierson |
| D136,381 | S | | 9/1943 | Ghez et al. |
| D170,768 | S | | 11/1953 | Preti |
| D174,475 | S | | 4/1955 | Smith |
| 2,715,285 | A | | 8/1955 | Del Vecchio |
| 3,468,040 | A | | 9/1969 | Fukuoka |
| 3,766,669 | A | | 10/1973 | Pearsall |
| 4,020,569 | A | | 5/1977 | Fukuoka |
| 4,020,570 | A | | 5/1977 | Shames |
| 4,033,054 | A | | 7/1977 | Fukuoka |
| 4,124,946 | A | | 11/1978 | Tomlin |
| 4,129,697 | A | | 12/1978 | Schapel et al. |
| D276,003 | S | | 10/1984 | McAbery |
| 4,508,774 | A | | 4/1985 | Grabhoefer et al. |
| 4,513,518 | A | | 4/1985 | Jalbert et al. |
| 4,551,930 | A | * | 11/1985 | Graham et al. ..... 36/30 R |
| D284,901 | S | | 8/1986 | Tilles |
| 4,627,177 | A | | 12/1986 | Meyers |
| 4,633,877 | A | | 1/1987 | Pendergast |
| 4,674,204 | A | | 6/1987 | Sullivan et al. |
| D294,537 | S | | 3/1988 | Le |
| 4,741,951 | A | | 5/1988 | Ricciardi et al. |
| 4,760,655 | A | | 8/1988 | Mauch |
| 4,864,740 | A | | 9/1989 | Oakley |
| 4,910,886 | A | * | 3/1990 | Sullivan et al. ..... 36/44 |
| 4,955,148 | A | * | 9/1990 | Padilla ..... 36/44 |
| 4,956,927 | A | * | 9/1990 | Misevich et al. ..... 36/32 R |
| 5,146,698 | A | | 9/1992 | Tilles et al. |
| 5,154,682 | A | * | 10/1992 | Kellerman ..... 36/44 |
| 5,167,999 | A | | 12/1992 | Wang |
| 5,203,793 | A | | 4/1993 | Lyden |
| D354,389 | S | | 1/1995 | Howlett et al. |
| D354,844 | S | | 1/1995 | Rinehart |
| 5,392,532 | A | | 2/1995 | Bray, Jr. et al. |
| 5,435,077 | A | | 7/1995 | Pyle |
| D366,140 | S | | 1/1996 | Finn |
| 5,483,757 | A | | 1/1996 | Frykberg |
| D366,956 | S | | 2/1996 | Gay |
| 5,542,196 | A | | 8/1996 | Kantro |
| 5,544,432 | A | | 8/1996 | Kita |
| 5,551,173 | A | | 9/1996 | Chambers |
| 5,611,153 | A | | 3/1997 | Fisher et al. |
| 5,664,342 | A | | 9/1997 | Buchsenschuss |
| 5,669,162 | A | | 9/1997 | Dyer |
| 5,675,914 | A | | 10/1997 | Cintron |
| 5,718,064 | A | | 2/1998 | Pyle |
| 5,787,608 | A | | 8/1998 | Greenawalt |
| D399,042 | S | | 10/1998 | Strawser et al. |
| D418,281 | S | | 1/2000 | Bray et al. |
| D423,766 | S | | 5/2000 | Genga |
| D426,373 | S | | 6/2000 | Allen et al. |
| D432,769 | S | | 10/2000 | Yung et al. |
| 6,176,025 | B1 | | 1/2001 | Patterson et al. |
| 6,205,684 | B1 | * | 3/2001 | Snyder ..... 36/35 R |
| 6,219,941 | B1 | | 4/2001 | Kukoff |
| 6,226,894 | B1 | | 5/2001 | Bray, Jr. et al. |
| 6,286,232 | B1 | | 9/2001 | Snyder et al. |
| 6,338,768 | B1 | | 1/2002 | Chi |
| 6,418,642 | B1 | | 7/2002 | Bigg et al. |
| 6,662,469 | B2 | | 12/2003 | Belley et al. |
| D485,664 | S | | 1/2004 | Bray, Jr. et al. |
| D485,665 | S | | 1/2004 | Bray, Jr. et al. |
| D485,666 | S | | 1/2004 | Bray, Jr. et al. |
| D490,970 | S | | 6/2004 | Bray, Jr. et al. |
| 6,931,763 | B2 | | 8/2005 | Bray, Jr. et al. |
| 6,990,754 | B2 | | 1/2006 | Bray, Jr. et al. |
| 2001/0039746 | A1 | | 11/2001 | Seiter |

FOREIGN PATENT DOCUMENTS

| | | |
|---|---|---|
| WO | WO 2004/012545 | 2/2004 |

OTHER PUBLICATIONS

Claims 'as filed' for U.S. Appl. No. 11/498,972, filed Aug. 2, 2006. Declaration of Walter Thomas Bray, Jr. including Exhibits A-1 (Color Photographs).

* cited by examiner

SLIPPER INSOLE, SLIPPER, AND METHOD FOR MANUFACTURING A SLIPPER

CROSS REFERENCE TO RELATED APPLICATION

This application is a continuation of and claims priority to U.S. application Ser. No. 10/213,276 that was filed with the United States Patent and Trademark Office on Aug. 5, 2002 now U.S. Pat. No. 6,990,754. The entire disclosure of U.S. application Ser. No. 10/213,276 is incorporated herein by reference.

This application is related to U.S. application Ser. No. 10/634,508 that was filed with the United States Patent and Trademark Office on Aug. 5, 2003, which is a continuation-in-part of U.S. application Ser. No. 10/213,276.

FIELD OF THE INVENTION

The invention relates to a slipper insole, a slipper, and a method for manufacturing a slipper.

BACKGROUND OF THE INVENTION

The footwear industry is an old and crowded art. The industry is constantly attempting to design new products with aesthetic appeal, as well as being comfortable and having ease of construction.

Various designs of slippers have been available for a number of years. See U.S. Pat. No. 5,392,532 (Bray, Jr. et al.) and U.S. Pat. No. 6,226,894 (Bray, Jr. et al.). In general, slippers are a type of footwear having a generally soft construction and are generally washable in a conventional clothes washing machine. Slippers are typically not manufactured using a last, which is often a necessary device when manufacturing a shoe, including a hard sole and a leather upper.

Insoles for various shoes and slippers have been manufactured using compression molding of various polymers. See U.S. Pat. No. 5,551,173 (Chambers) and U.S. Pat. No. 3,766,669 (Pearsal). The insole provides a cushion and support for the foot. The comfort felt by the wearer of a shoe or slipper depends, in large part, on the ability of this foam insole to redistribute the various forces imposed on the foot during walking and standing. These forces are greatest in the heel, arch, and forefoot regions.

SUMMARY OF THE INVENTION

An insole is provided according to the invention. The insole can be placed with an insole receiving area of a slipper. The insole can be prepared by compression molding a structure comprising a foam layer having a first foam side and a second foam side. The insole includes a heel region, an arch region, and a toe region. The heel region includes a heel cushioning portion and a heel perimeter portion. The heel perimeter portion includes a retaining wall that extends above the top surface of the heel cushioning portion. The arch region includes an arch cushioning portion and an arch perimeter portion. The arch perimeter portion includes an arch support that extends above the top surface of the arch cushioning portion. The toe region includes a toe cushioning portion and a toe perimeter portion.

A slipper is provided according to the invention. The slipper includes an outsole, an upper, and an insole. The outsole includes a top outsole side, a bottom outsole side, and an outsole retaining wall extending along a circumference of the outsole. The upper includes an outsole attachment area, a foot covering area, and a stabilizing member. The stabilizing member is attached along the outsole attachment area to provide an insole receiving area between the stabilizing member and the foot covering area. The outsole attachment area is attached to the outsole retaining wall. The insole can be placed within the insole receiving area.

A method for manufacturing a slipper is provided by the invention. The method includes steps of attaching an upper to an outsole, and placing an insole within the insole receiving area formed within the upper.

DETAILED DESCRIPTION OF THE INVENTION

Figure 1:
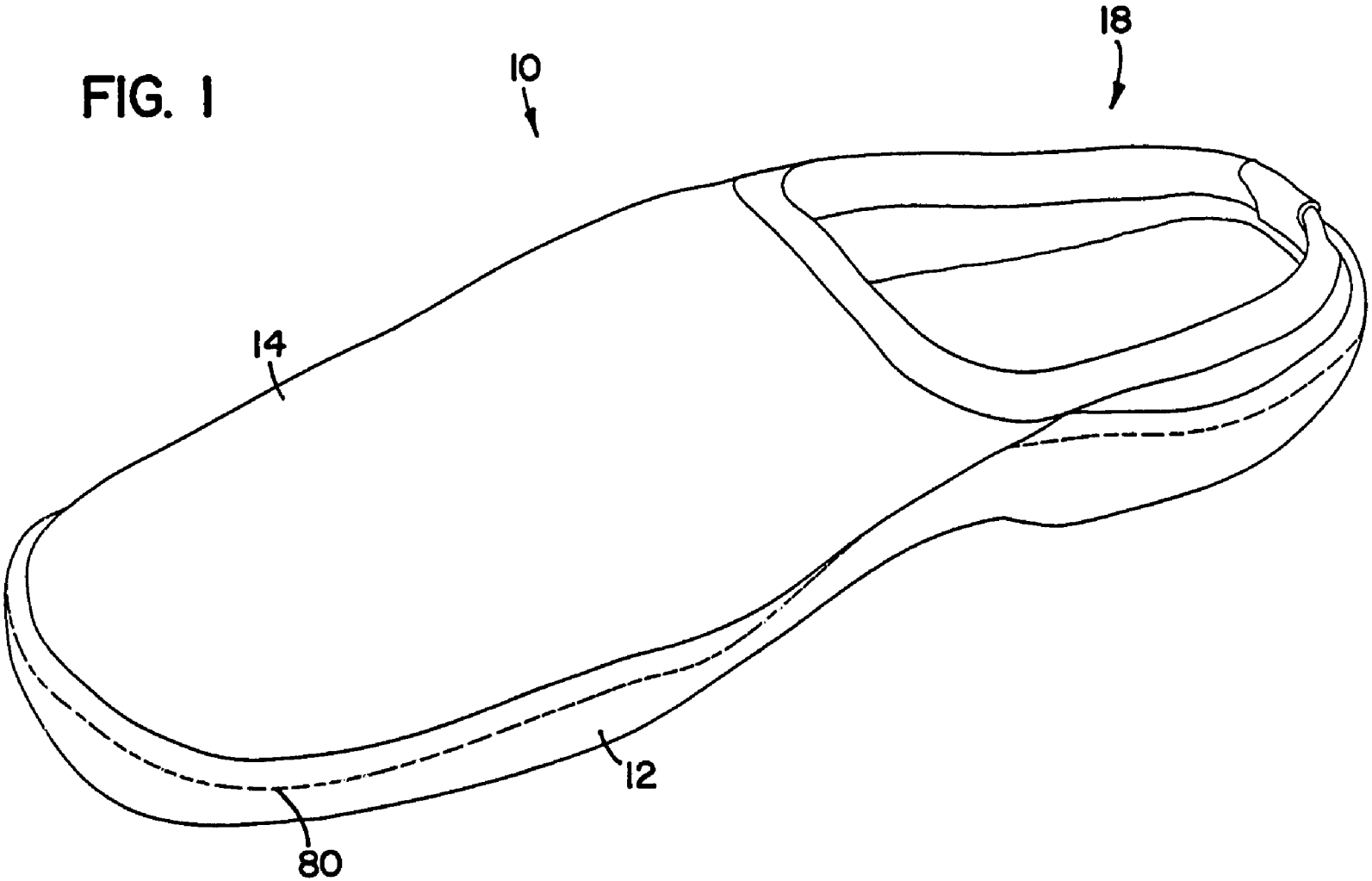
FIG. 1 is a perspective view of a slipper construction according to the principles of the invention wherein the contoured footbed has been removed.

Referring to FIGS. 1-5, a slipper according to the present invention is shown at reference numeral 10. The slipper 10 includes an outsole 12, an upper 14, and an insole 16. The insole 16 is removable from the insole receiving area 18 and is shown removed in FIGS. 1 and 5. The slipper 10 can be characterized as having a generally soft construction while providing support for a wearer's foot.

Figure 3:
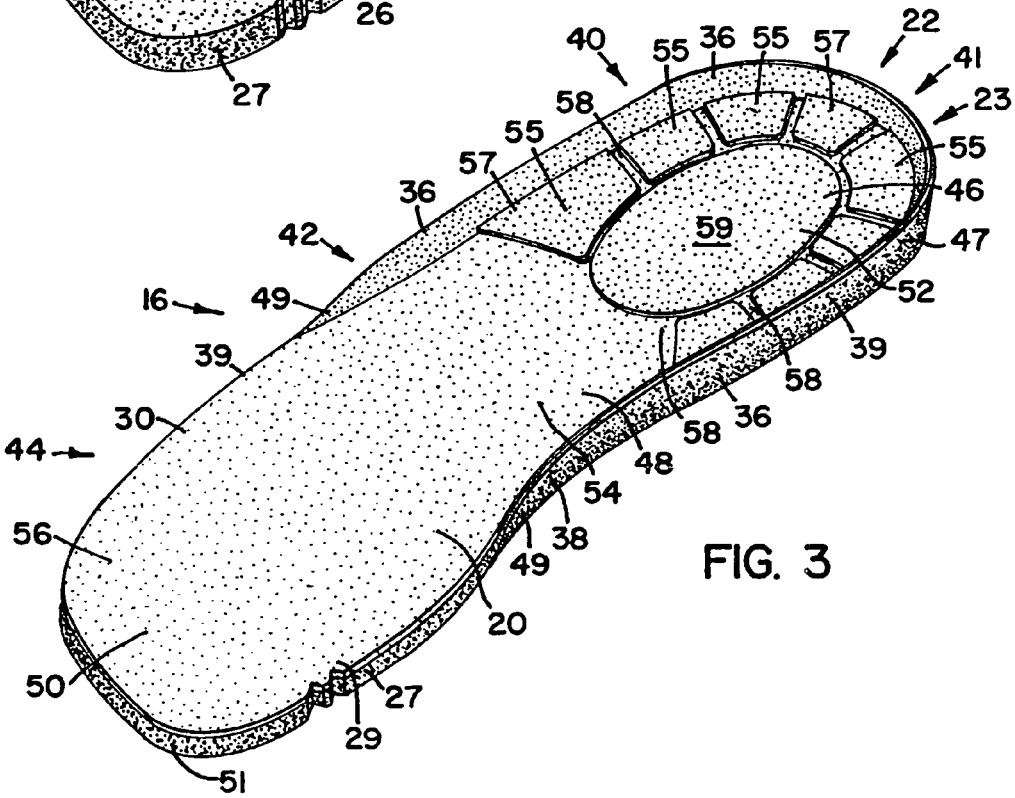
FIG. 3 is a perspective view of an insole according to the principles of the invention.
Figure 4:
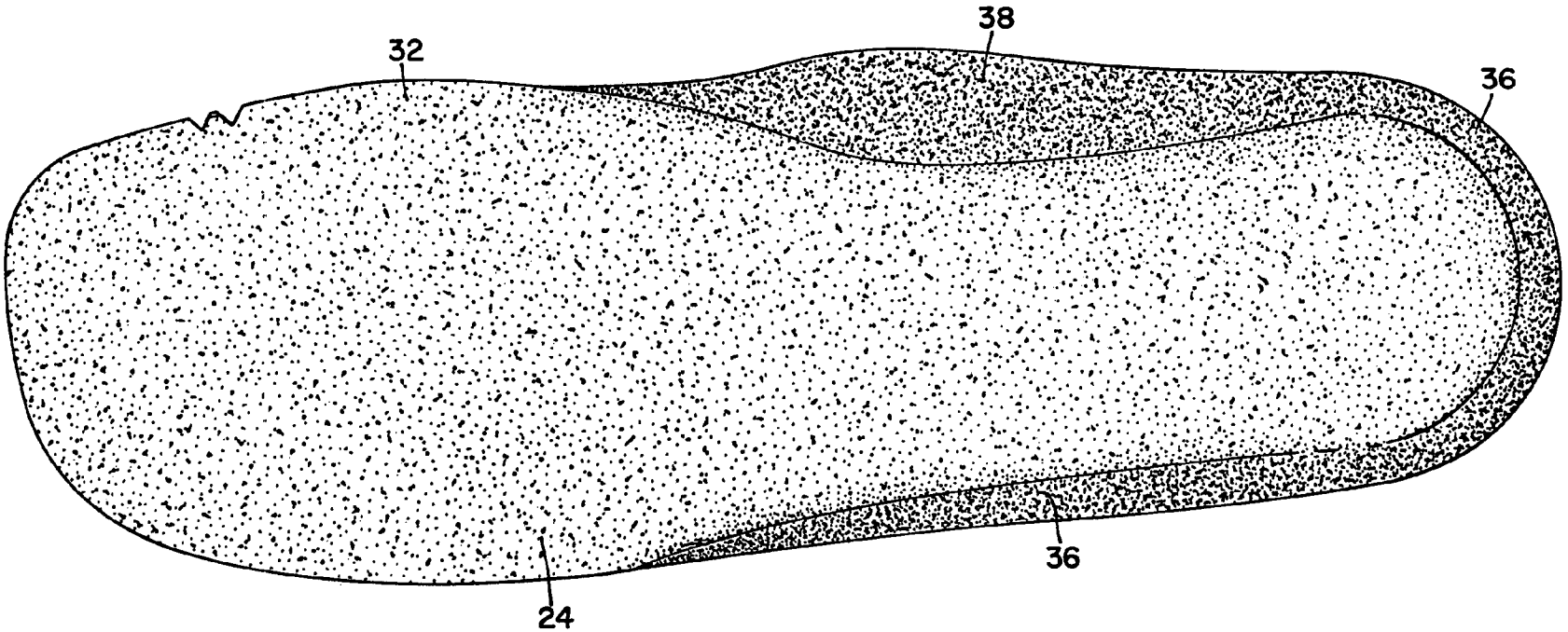
FIG. 4 is a bottom view of the insole of FIG. 3.

The insole 16 has a top surface 20 and a bottom surface 24. As shown in FIG. 3, the top surface 20 includes a contour design 22 in a heel cup region 23. When the insole 16 is provided within the insole receiving area 18, the contour design 22 is readily visible to someone looking at the slipper 10. It is believed that the contour design 22 provides visual interest for a customer of the slipper and may cause the customer to examine the slipper 10 more closely. It is believed that customers will associate the contour design 22 with slippers having an insole according to the invention. In addition, the contour design 22 is believed to provide additional cushioning.

The insole 16 can be assembled by laminating a first layer 26 and a second layer 28 to provide a laminate construction 30, and compression molding the laminate construction 30. The first layer 26 can be a foam layer 27, and the second layer 28 can be a fabric layer 29. The foam layer 27 includes a first foam side 31 and a second foam side 32. The fabric layer 29 includes a first fabric side 33 and a second fabric side 34. The fabric layer 29 is placed over the foam layer 27 so that the second fabric side 34 is adjacent to the first foam side 31. The fabric layer 29 can be held in place on the foam layer 27 by an adhesive. Adhesive can be applied as a dry powder adhesive, a hot melt adhesive, a water based adhesive, etc. to hold the fabric layer 29 in place on the foam layer 27. It is expected that the compression molding step will cause a portion of the foam layer 27 to melt thereby creating a bond between the fabric layer 29 and the foam layer 27.

The foam layer 27 can be prepared from any foam material that exhibits the desired level of support and resiliency that is appropriate for use as an insole. An exemplary foam material that can be used includes ethylene vinyl acetate. A particular form of ethylene vinyl acetate that can be used is sponge ethylene vinyl acetate. The density of the foam layer should be sufficient to provide the desired level of support after the foam has been compression molded. If the foam density is too low, it is expected that insufficient support will be provided. If the foam density is too high, it is expected that the foam will be too rigid. A desirable foam density range can be between about 4 $lb/ft^2$ and about 10 $lb/ft^2$ prior to compression molding. In general, it is difficult to measure the density of the foam layer 27 after compression molding because different parts of the insole 16 can be compressed to different levels.

Figure 2:
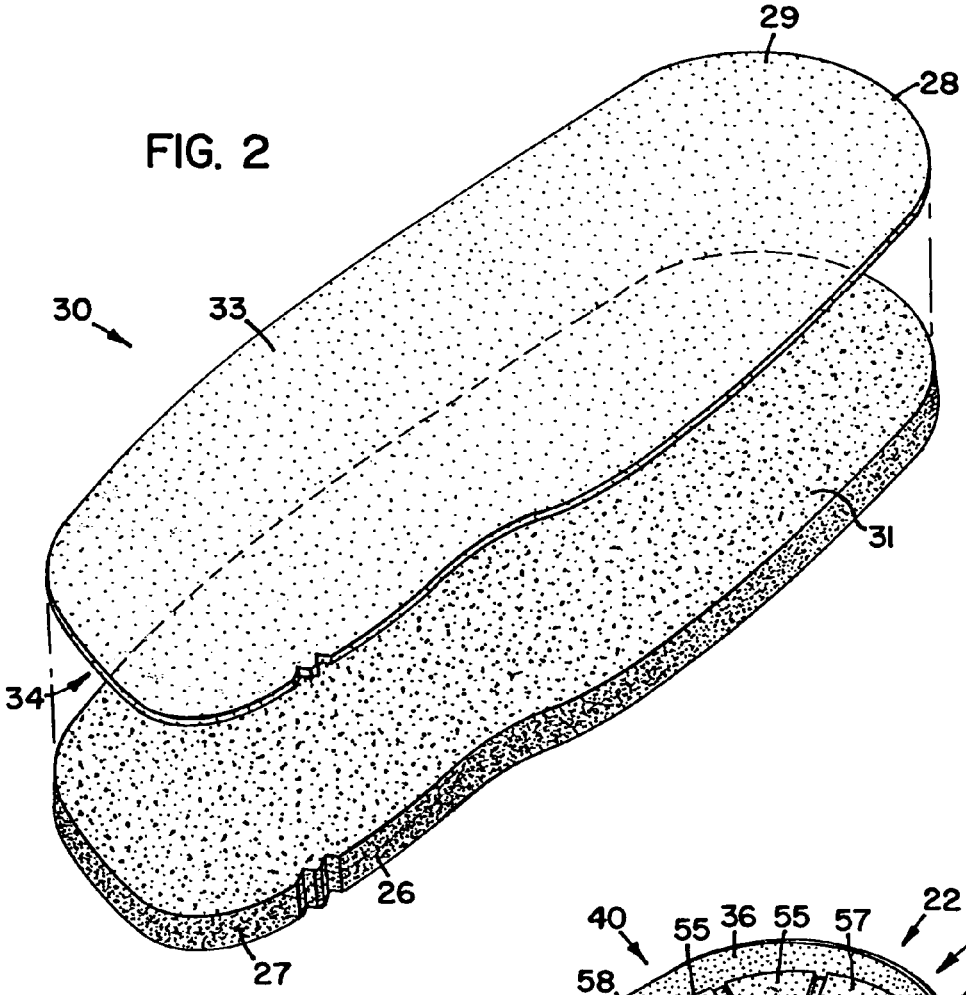
FIG. 2 is a perspective, assembly view of an insole according to the principles of the invention prior to compression molding.

It is pointed out that the foam layer 27 shown in FIG. 2 is not necessarily drawn to scale. It is expected that a relatively thick foam layer 27 will be compressed to provide the insole 16. For example, the foam layer can be provided as a 3 inch block that is molded to provide a desired final thickness.

The fabric layer 29 can be formed from any type of fabric material that adheres to the foam layer 27 and provides a desired surface texture. The fabric layer can be a woven material, a nonwoven material, or a knitted material. Because it is desirable for the contour design 22 to be visible, it is generally desirable for the fabric layer 29 to have a nap that is sufficiently small (if it exists at all) so it does not obscure the contour design 22. In general, it is expected that the nap will be less than about 4 mm. An exemplary fabric material that can be used includes microfiber sueded fabric. An exemplary microfiber sueded fabric includes a fabric prepared from polyester.

It should be understood that the insole according to the invention can be provided without the fabric layer 29. If there is no fabric layer 29, the wearer's foot can directly contact the foam layer 27.

The insole 16 additionally includes a retaining wall 36 and an arch support 38. The contour design 22, the retaining wall 36, and the arch support 38 can be formed during the compression molding step. The retaining wall 36 extends along a portion of the insole perimeter 39. The arch support 38 extends along a portion of the insole perimeter in the region where arch support is desired.

The insole 16 includes three general regions. These regions include a heel region 40, an arch region 42, and a toe region 44. In general, the heel region 40 includes that portion of the insole 16 that generally contains and supports the wearer's heel. The toe region 44 includes that portion of the insole 16 that generally contains and supports the wearer's toes. The arch region 42 is generally that portion of the insole 16 provided between the heel region 40 and the toe region 44 and provides support for the wearer's arch. It should be understood that there can be some degree of overlap between the regions. The heel region 40 includes a heel cushioning area 46 and a heel perimeter 47, the arch region 42 includes an arch cushioning area 48 and an arch perimeter 49, and the toe region 44 includes a toe cushioning area 50 and a toe perimeter 51. It should be understood that the cushioning areas 46, 48, and 50 refer to the portions of the insole 16 that cushions the corresponding part of a wearer's foot, and the perimeters 47, 49, and 51 refer to portions of the insole perimeter 39 of the insole 16.

As shown in FIG. 3, the retaining wall 36 extends around the heel perimeter 47 and into the arch perimeter 49. For the design shown in FIG. 3, the retaining wall 36 does not extend into the toe perimeter 51. The retaining wall 36 is constructed so that it extends above the heel cushioning area top surface 52 and the arch cushioning area top surface 54 to an extent sufficient to help retain the wearer's foot in its proper location on the insole 16. The retaining wall 36 can have a varying height depending upon whether it is located in the heel region 40 or the arch region 42. The retaining wall 36 can have a height that is sufficient for providing containment and/or support of the wearer's foot, but should not be so high that it causes discomfort. An exemplary range for the retaining wall 36 can be between about ¼ inch and about 1 inch. In many applications, it is expected that the retaining wall 36 will have a height of about ⅞ inch above the heel cushioning area top surface 52 and the arch cushioning area top surface 54. Because it is expected that the toe region 44 will be compressed more than the heel region 40 and the arch region 42, it is expected that the toe cushioning area top surface 56 will be lower than the heel cushioning area top surface 52 and the arch cushioning area top surface 54. In addition, it should be understood that the retaining wall 36 can decrease until it merges with the arch cushioning area top surface 54 and/or the toe cushioning area top surface 56.

The combination of the heel cushioning area 46 and the retaining wall 36 provided in the heel perimeter 47 provides a structure that can be referred to as the heel cup region 23 because it acts to contain the wearer's heel and keep it in a stationary position. The heel cushioning area 46 includes the contour design 22. In addition to providing visual interest to a customer, it is believed that the contour design 22 provides additional cushioning. The contour design 22 includes areas of relatively lower density foam 57 and areas of relatively higher density foam 58. The contour design 22 shown in FIG. 3 can be referred to as a starburst pattern 41 because it includes a relatively low density central area 59 surrounded by isolated domains of relatively low density foam 55. It should be understood that the reference to low density foam refers to the comparison with the adjacent areas of relatively higher density foam 58. The difference in height between the lower density foam areas 57 and the higher density foam areas 58 should be sufficient to be readily visible upon inspection of the insole 16, but should not be so large as to cause discomfort. In general, it is expected that the difference in height between the low density area 57 and the higher density areas 58 will be between about 1/16 inch and about 3/16 inch.

Figure 5:
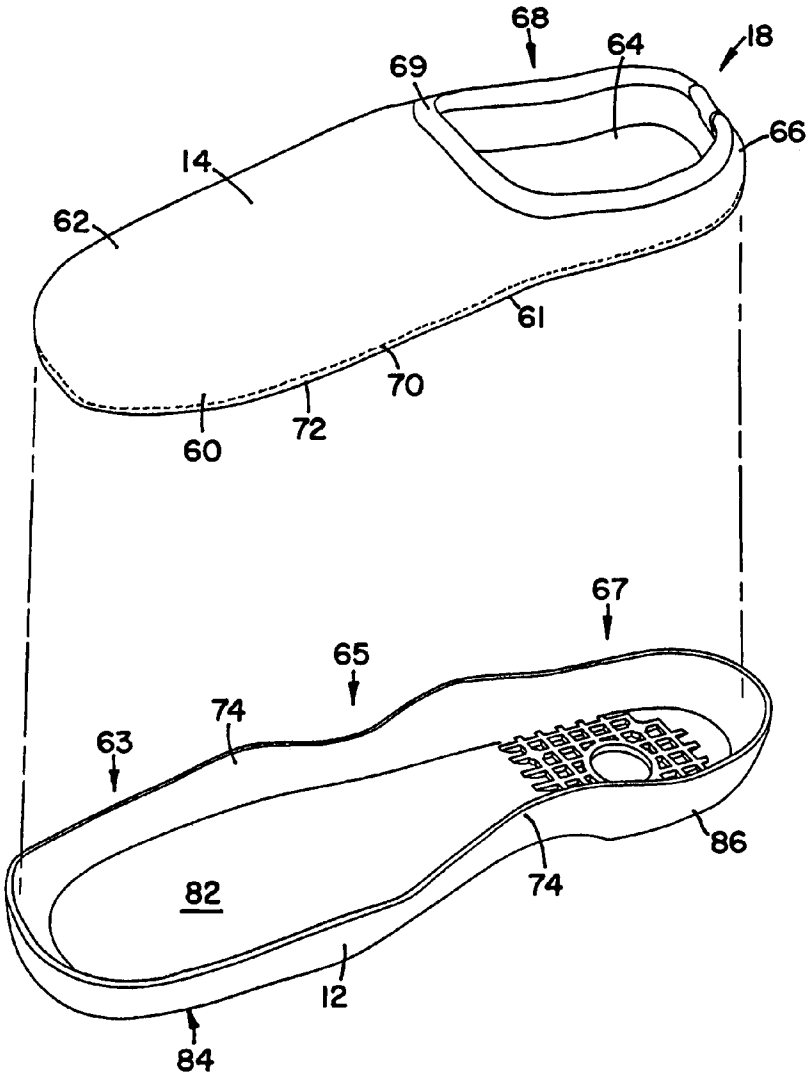
FIG. 5 is a perspective, assembly view of the slipper construction of FIG. 1.

Now referring to FIG. 5, the upper 14 is shown separated from the outsole 12. The upper 14 includes an outsole attachment area 60, a foot covering area 62, and a stabilizing member 64. The outsole attachment area 60 is provided along the upper 14 covering the length of attachment between the upper 14 and the outsole 12. For the construction of the upper 14 shown in FIG. 5, the outsole attachment area 60 extends around the entire upper circumference 61. That is, the outsole attachment area 60 extends to provide attachment to the outsole 12 in the toe region 63, the arch region 65, and the heel region 67. The combination of the outsole attachment area 60 and the foot covering area 62 provided in the heel region 40 can be referred to as the heel wrap upper 66. The foot covering area 62 includes an opening 68 that allows for the insertion of a foot into the foot receiving area 18. Binding 69 can be provided along the foot covering area 62 to provide a finished appearance to the opening 68.

The stabilizing member 64 is attached to the upper 14 along the outsole attachment area 60. One technique for attaching the stabilizing member 64 along the outsole attachment area 60 is by sewing to create a stitch line 70 and a seam allowance 72. The upper 14 can then be attached to the outsole 12 along the outsole retaining wall 74 to hide the stitch line 70 and the seam allowance 72. The upper 14 can be attached to the outsole 12 by stitching to create a stitch line 80 as shown in FIG. 1.

The outsole 12 includes an outsole top side 82, an outsole bottom side 84, and an outsole retaining wall 74. The outsole retaining wall 74 extends above the outsole top side 82 along the perimeter 86.

The upper 14 can be prepared from any fabric material commonly used in the manufacture of a slipper. The stabilizing member 64 can be provided from the same type of material used to provide the outsole attachment area 60. In general, the stabilizing member 64 is provided to assist with the attachment of the upper 14 to the outsole 12. The stabilizing member 64 helps the upper 14 maintain its shape during the step of attaching the upper 14 to the outsole 12. Although the upper can be attached to the outsole by stitching, it should be appreciated that other techniques can be used including adhesive bonding.

Figure 6:
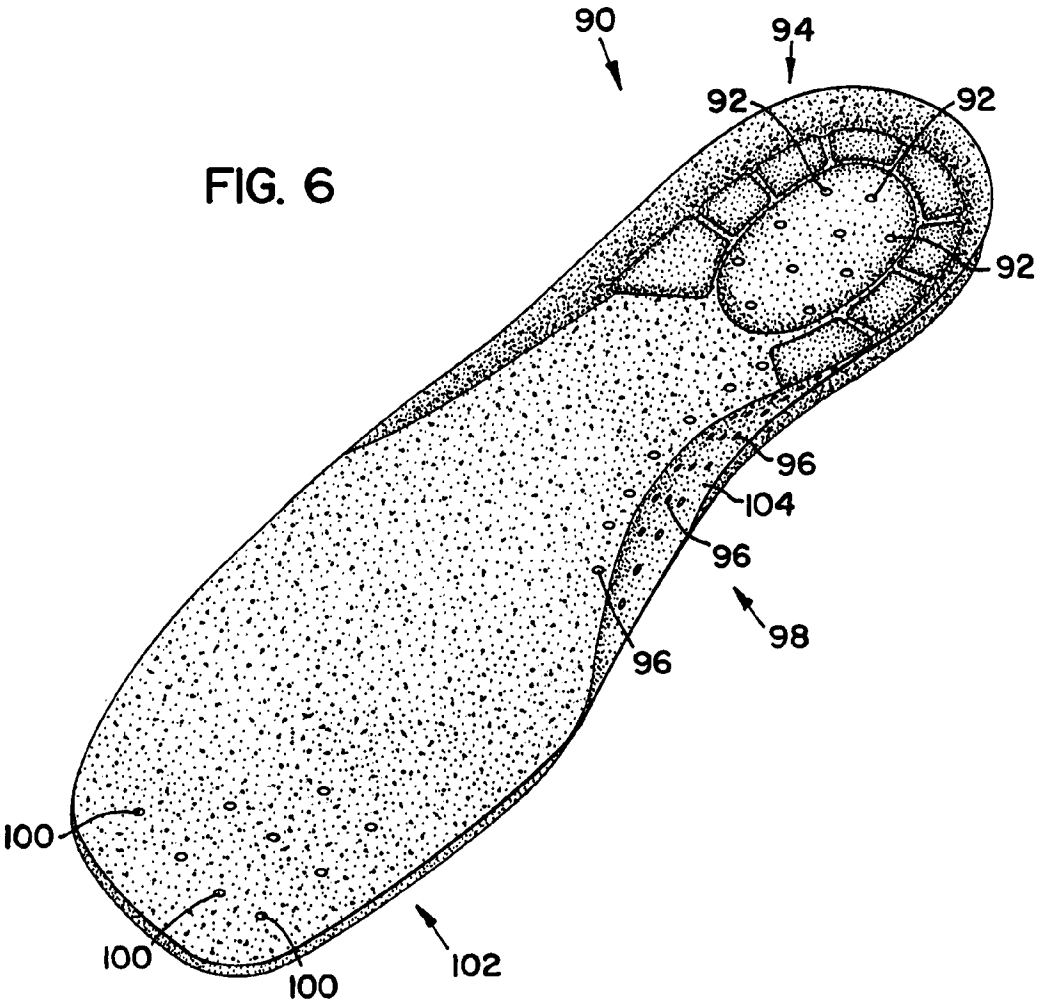
FIG. 6 is a perspective view of an alternative embodiment of an insole according to the principles of the invention.

Now referring to FIG. 6, an alternative design of an insole according to the principles of the invention is shown at reference numeral 90. The insole 90 includes a plurality of perforations 92 provided in the heel region 94, a plurality of perforations 96 provided in the arch region 98, and a plurality of perforations 100 provided in the toe region 102. The perforations provide for additional air circulation in order to make the slipper more comfortable to a wearer. In addition, the presence of the perforations 96 in the arch support 104 helps provide flexibility to the arch support 104. In general, slippers are available in whole sizes, and slippers are generally not available in half sizes. Accordingly, by providing a more flexible arch support 104, it is possible to provide the insole 90 with a larger degree of fit for various individuals.

The insole according to the invention can be characterized as a removable, contoured footbed. That is, the insole is removable from the insole receiving area. It is expected that the insole may be spot glued in place within the insole receiving area to simply hold it in place until it is desired to remove the insole. The insole can be referred to as a contoured footbed because of the retaining wall, the arch support, and the contoured pattern. It is expected that the combination of the retaining wall and the arch support, when combined with the outsole retaining wall, will help stabilize a wearer's foot within the slipper.

Various embodiments of the slipper and contoured footbed according to the invention are shown in U.S. application Ser. No. 29/165,186, filed on Aug. 5, 2002, now U.S. Pat. No. D485,664, U.S. application Ser. No. 29/165,204, filed on Aug. 5, 2002, now U.S. Pat. No. D485,666, U.S. application Ser. No. 29/165,190, filed on Aug. 5, 2002, now U.S. Pat. No. D485,665 and U.S. application Ser. No. 29/165,183, filed on Aug. 5, 2002, now U.S. Pat. No. D490,970. The entire disclosures of these four United States patent applications are incorporated herein by reference in their entirety.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A slipper comprising:

(a) an outsole;

(b) an upper;

(c) an insole comprising a product of compression molding a structure comprising a foam layer to provide an insole comprising:

(i) a heel region having a heel cushioning portion and a heel perimeter portion, wherein the heel perimeter portion comprises a retaining wall that extends above the top surface of the heel cushioning portion;

(ii) wherein the heel cushioning portion includes a contour design comprising a higher density foam area and a plurality of isolated lower density foam areas positioned along a heel perimeter portion, the plurality of isolated lower density foam areas separated from each other by portions of the higher density foam area.

2. A slipper according to claim 1 wherein:

(a) the contour design includes a lower density foam area that is surrounded by the first higher density foam area.

3. A slipper according to claim 1, wherein:

(a) the insole is separable from the outsole.

4. A slipper according to claim 1, wherein:

(a) the insole includes an arch region having an arch cushioning portion and an arch perimeter portion.

5. A slipper according to claim 4, wherein (a) the arch cushioning portion comprises foam.

6. A slipper according to claim 1, wherein:

(a) the insole includes a toe region having a toe cushioning portion and a toe perimeter portion.

7. A slipper according to claim 6, wherein (a) the toe cushioning portion comprises foam.

8. A slipper according to claim 1, wherein (a) the contour design comprises starburst patterning.

9. A slipper according to claim 8, wherein:

(a) the insole is removable from the slipper.

10. A slipper according to claim 1, wherein:

(a) the heel region includes a plurality of perforations in the heel cushioning portion.

11. An insole comprising:

(a) a result of compression molding a structure comprising a foam layer having a first foam side and a second foam side, to provide an insole comprising:

(i) a heel region having a heel cushioning portion and a heel perimeter portion, wherein the heel perimeter portion comprises a retaining wall that extends above the top surface of the heel cushioning portion;

(b) wherein the heel cushioning portion comprises a contour design including a higher density foam area and a plurality of isolated lower density foam areas positioned along a heel perimeter portion, the plurality of isolated lower density foam areas separated from each other by portions of the higher density foam area.

12. An insole according to claim 11 wherein:

(a) the contour design includes a lower density foam area that is surrounded by the first higher density foam area.

13. An insole according to claim 11 further comprising:

(a) a toe region having a toe cushioning portion and a toe perimeter portion.

14. An insole according to claim 13, wherein (a) the toe cushioning portion comprises foam.

15. An insole according to claim 11 further comprising:

(a) an arch region having an arch cushioning portion and an arch perimeter portion.

16. An insole according to claim 15, wherein (a) the arch cushioning portion comprises foam.

17. An insole according to claim 11, wherein:

(a) the heel region includes a plurality of perforations in the heel cushioning portion.

18. An insole according to claim 11, wherein (a) the contour design comprises starburst patterning.

19. A slipper comprising:

(a) an outsole;

(b) an upper;

(c) an insole comprising a product of compression molding a structure comprising a foam layer to provide an insole comprising:

(i) a toe region having a toe cushioning portion and a toe perimeter portion;

(ii) an arch region having an arch cushioning portion and an arch perimeter portion;

(iii) a heel perimeter portion; and (iv) a heel cushioning region including a plurality of isolated lower density foam areas positioned along the heel perimeter portion and separated from each other by portions of a higher density foam area.

20. A slipper according to claim 19, wherein:

(a) the insole further includes a central heel cushioning region.

21. A slipper according to claim 20, wherein:

(a) the central heel cushioning region is at least partially surrounded by the lower density foam areas.

22. A slipper according to claim 20, wherein:

(a) the central heel cushioning area comprises foam.

23. A slipper according to claim 20, wherein:

(a) the central heel cushioning area is a lower density foam area.

24. A slipper according to claim 20, wherein:

(a) the central heel cushioning area is integrally formed with the insole.

25. A slipper according to claim 19, wherein:

(a) the insole is removable from the slipper.

26. An insole comprising:

(a) a compression molded foam layer having a first foam side and a second foam side at least partially forming an insole and comprising:

(i) a toe region having a toe cushioning portion and a toe perimeter portion;

(ii) an arch region having an arch cushioning portion and an arch perimeter portion; and (iii) a heel perimeter portion; and (iv) a heel cushioning region including a plurality of isolated lower density foam areas positioned along the heel perimeter portion and separated from each other by portions of a higher density foam area.

27. An insole according to claim 26, further comprising:

(a) a central heel cushioning region.

28. An insole according to claim 27, wherein:

(a) the central heel cushioning region is at least partially surrounded by the lower density foam areas.

29. An insole according to claim 27, wherein:

(a) the central heel cushioning area comprises foam.

* * * * *